United States Patent [19]

Thibault

[11] Patent Number: 4,599,779

[45] Date of Patent: Jul. 15, 1986

[54] CONSTRUCTION TOOL

[76] Inventor: Eric Thibault, 15 Lake Pkwy., Webster, Mass. 01570

[21] Appl. No.: 537,801

[22] Filed: Sep. 30, 1983

[51] Int. Cl.[4] ..... E04G 21/16

[52] U.S. Cl. ..... 29/283; 81/488; 269/1

[58] Field of Search ..... 294/1 R, 15, 17, 19 R, 294/26, 92; 52/DIG. 1, 749; 81/3 R, 125.1; 145/1 R; 269/1; 29/270, 271, 275, 283

[56] References Cited

U.S. PATENT DOCUMENTS

| | | | |
|---|---|---|---|
| 2,216,288 | 10/1940 | Anderson | 269/1 |
| 3,616,514 | 11/1971 | Laverty | 81/3 R X |
| 3,913,423 | 10/1975 | Gerst | 81/3 R |

*Primary Examiner*—Johnny D. Cherry

*Attorney, Agent, or Firm*—Blodgett & Blodgett

[57] ABSTRACT

A construction tool for metal framing elements having a generally U-shaped cross-sectional configuration comprising a main body portion having a pair of opposite end surfaces adapted to abut the opposite side walls of the framing element, and a handle which is fixed to the main body portion and extends laterally therefrom. Each end surface of the main body portion has a recess.

9 Claims, 6 Drawing Figures

CONSTRUCTION TOOL

BACKGROUND OF THE INVENTION

The present invention relates generally to a construction tool for building construction and particularly to a construction tool for building construction in which metal U-shaped framing elements are used.

Metal U-shaped framing elements are used primarily for interior construction and remodeling. They are also used for exterior construction in which I-beam supports are used.

When U-shaped forming elements are used in construction, some of the elements are attached to the floor and ceiling so that the open side of the elements on the floor face the open side of the elements which are attached to the ceiling. Additional U-shaped framing elements are then inserted within the sides of the upper and lower elements so that they extend vertically and function as studs. The ends of the vertical U-shaped elements are positioned within the horizontal elements by screws or other fastening means. Wall board, paneling or laths are then fastened to the studs by screws or other fastening means.

There are two major problems encountered with the use of U-shaped framing elements in construction. The first problem is the difficulty in attaching one framing element to another. In order for two fastening elements to penetrate the metal sides of the framing elements, considerable pressure must be applied to the screws or other fastening elements. This causes the sides of the elements to bend, which distorts the elements or prevents fastening of the elements altogether. The operator must grasp the framing elements to be attached with one hand while applying the fastening elements with the other hand. Even this prevents the sides of the elements from bending when applying the screws.

The second problem in the use of U-shaped framing elements is in maintaining the vertical or stud elements in proper alignment relative to the horizontal elements and to each other. It is very difficult to position all of the stud elements so that all of the side walls are parallel and properly aligned, and the studs properly spaced. Even if proper positioning and alignment of the studs is accomplished, they may become misaligned during fastening of the studs to the horizontal framing elements.

In an effort to deal with the above problems, tools have been developed for bracing the side walls of the elements. The tool includes a rigid member adapted to be inserted in the side walls of a U-shaped framing element which is used as a stud for applying dry wall or paneling to the studs. However, the prior art tools have been found to be less than satisfactory for bracing the side walls to allow the U-shaped framing elements to be fastened together and to prevent misalignment of the framing elements during fastening. These and other difficulties experienced with the prior art devices have been obviated by the present invention.

It is, therefore, an outstanding object of the invention to provide a construction tool for bracing the side walls of U-shaped framing elements to permit two framing elements to be attached at their side walls by fastening means without distorting or bending the side walls.

Another object of this invention is the provision of a construction tool which provides firm bracing for attaching two U-shaped forming elements along their side walls while simultaneously maintaining the framing elements in proper alignment relative to each other and to other framing elements in the construction.

A further object of the present invention is the provision of a construction tool which provides firm bracing for attaching two U-shaped framing elements along their side walls and which is also effective for properly aligning the framing elements prior to fastening and to maintain the elements in alignment during fastening.

It is another object of the instant invention to provide a construction tool which is simple in construction, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a construction tool for metal framing elements having a generally U-shaped cross-sectional configuration. The construction tool comprises a main body portion having a pair of opposite end surfaces, each of the surfaces having a recess, and a handle which is fixed to the main body portion and extends laterally therefrom. The distance between the end surfaces of the main body portion is equal to the distance between the side walls of the framing element. More specifically, each of the recesses is defined by a pair of spaced flanges.

BRIEF DESCRIPTION OF THE DRAWINGS

The character of the invention, however, may be best understood by reference by one of its structural forms, as illustrated by the accompanying drawings, in which.

DESCRIPTION OF THE PREFERRED EMBODIMENT

Figure 1:
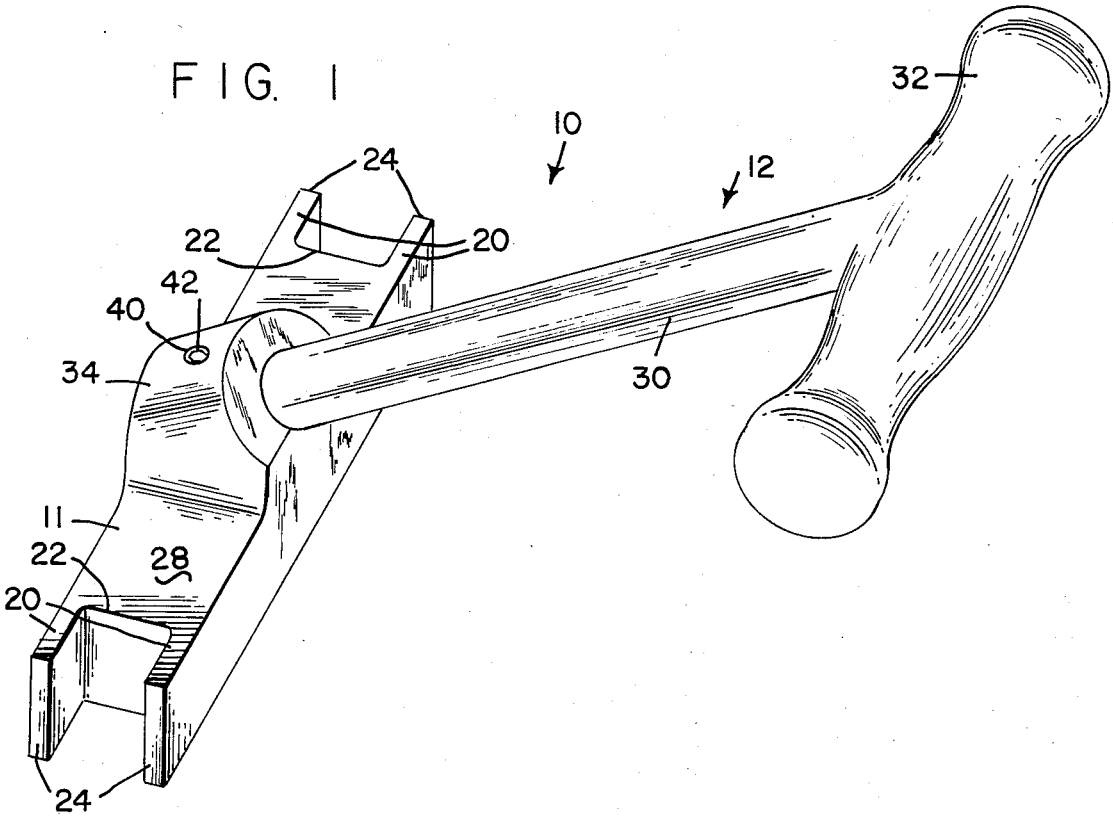
FIG. 1 is a perspective view of the construction tool embodying the principles of the present invention.
Figure 2:
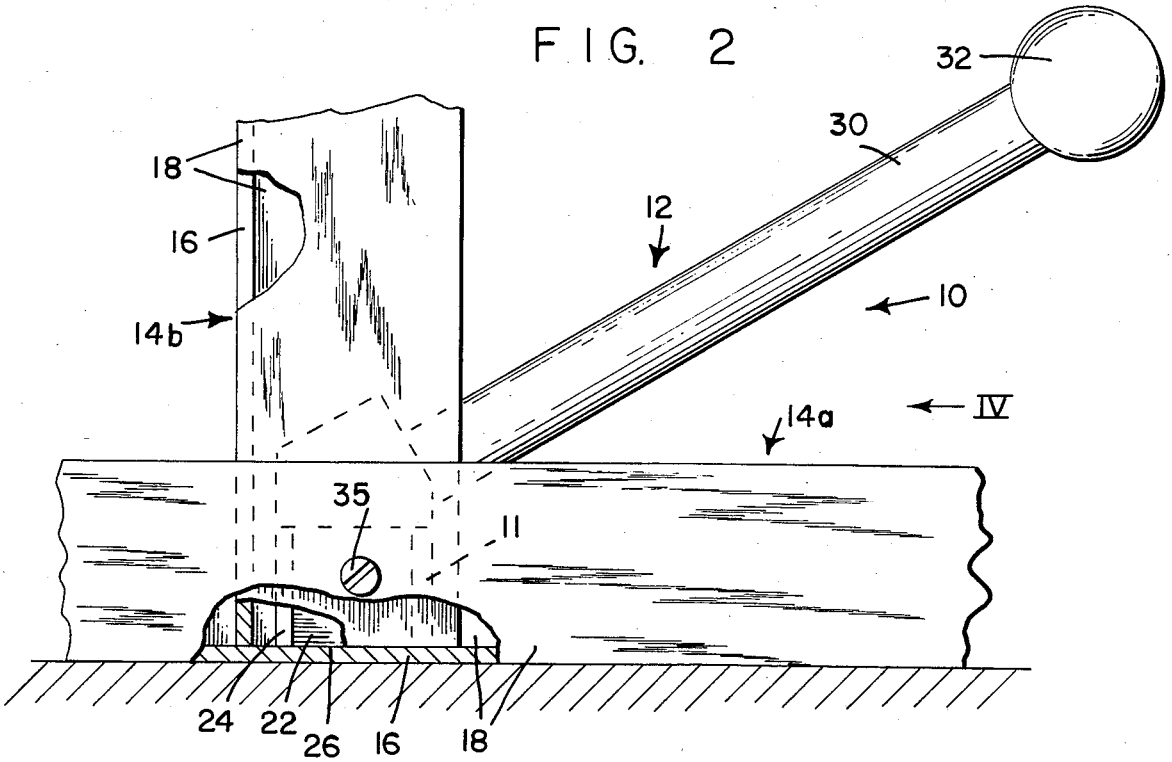
FIG. 2 is a side elevational view of the construction tool as applied to a pair of U-shaped metal framing elements which are to be connected.
Figure 3:
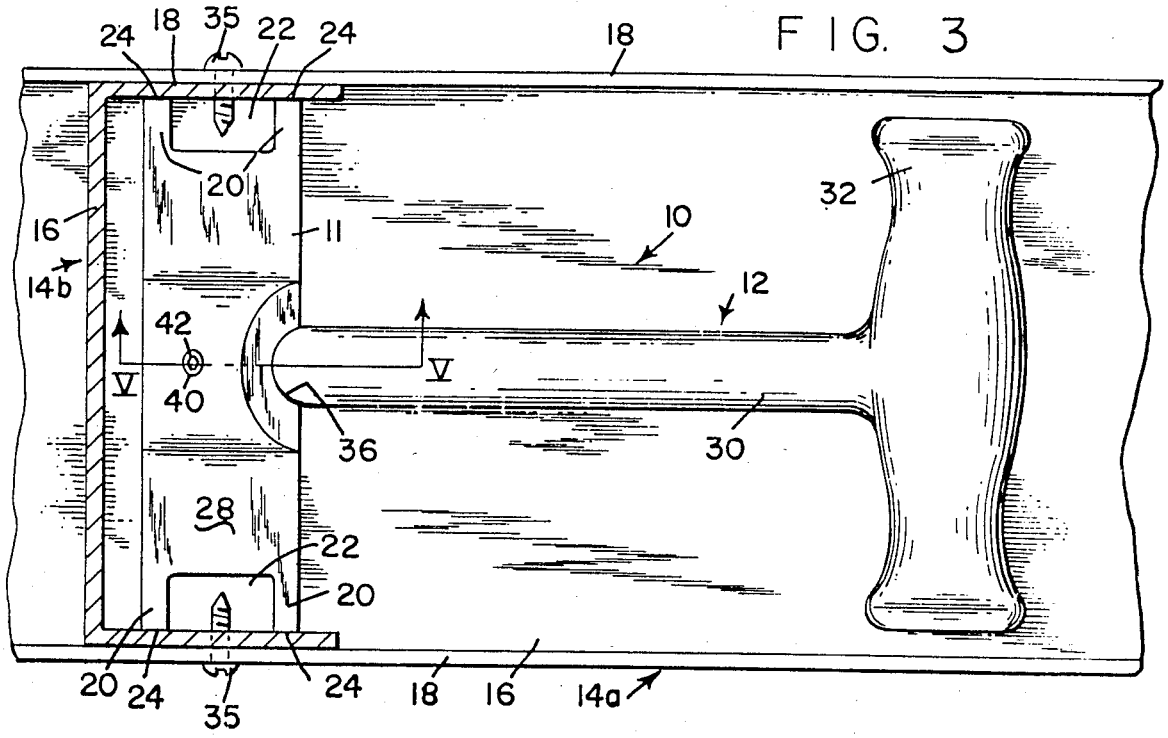
FIG. 3 is a plan view of a construction tool shown in operative position with respect to the two framing elements illustrated in FIG. 2.
Figure 4:
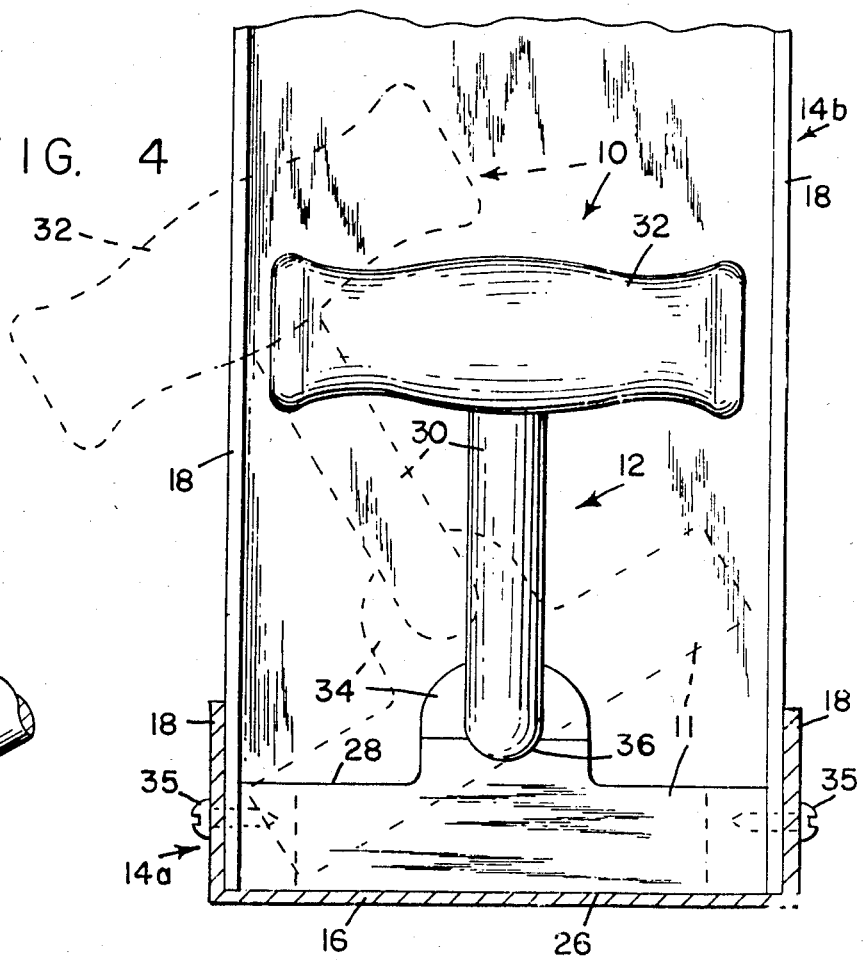
FIG. 4 is an end view of the construction tool looking in the direction of arrow IV of FIG. 2.
Figure 5:
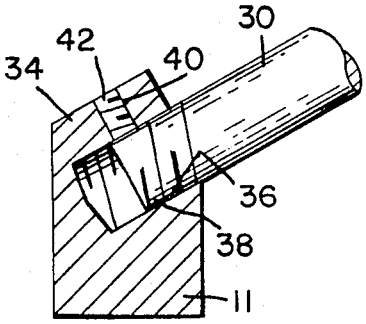
FIG. 5 is a vertical cross-sectional view taken on the line V—V of FIG. 3.

Referring first to FIG. 1, which best shows the general feature of the invention, the construction tool is generally indicated by the reference number 10 and comprises a main body portion 11 and a handle portion generally indicated by the reference 12. The construction tool 10 is adapted for metal framing elements having a generally U-shaped cross-sectional configuration consisting of a bottom wall and two side walls. The side walls are substantially parallel with each other and the distance between the side walls is defined as the width of the framing element. Referring also to FIGS. 2–4, the construction tool 10 is shown applied to a pair of framing elements 14*a* and 14*b* which are to be connected together. The framing element 14*a* is attached to the floor and the framing element 14*b* is inserted within the side walls of the framing element 14*a* and extends vertically to function as a stud. The bottom wall of each framing element is indicated by the reference numeral 16 and the side walls are indicated by the reference numeral 18.

Each end of the main body portion 11 includes a pair of spaced parallel flanges 20 which define therebetween a recess 22. Each flange 20 has a flat outer surface 24. The main body portion 11 has a top surface 28 and a bottom surface 26. The recess 22 extends from the bottom surface 26 to the top surface 28, as shown in FIG. 1. The handle portion 12 comprises a shank portion 30 removably attached at one end to the body portion 11 and a transverse rod 32 which is fixed to the opposite end of the shank portion 30 and functions as a hand grip for the handle. The top of the main body portion 11 has an enlarged area or abutment 34 which is provided with a threaded bore 36. The abutment 34 is located midway between the end surfaces 24. The one end of the shank portion 30 is provided with threads 38 which enable the one end of the shank to be threaded into the bore 36. The abutment 34 is also provided with an aperture 40 which intersects the bore 36. A set screw 42 is threaded into the aperture 40 for locking the shank 30 in the inserted positioning within the bore 36. The shank portion 30 extends laterally from the main body portion 11 and at an angle relative to the top surface 28.

The removable handle 12 enables a single handle to be used with head portions of different sizes to accommodate framing elements of different sizes. For example, at the present time framing elements are available in the same standard sizes commonly used for framing lumber.

The operation and advantages of the present invention will now be readily understood in view of the above description. After the framing element 14*a* is attached to the floor so that the sides 18 extend upwardly as shown in FIG. 2, a plurality of elements 14*b* are positioned endwise between the side wall 18 of the element 14*a* so that they extend vertically to function as studs. Only one such stud element 14*b* is shown in FIGS. 2–4. It is to be understood that there are additional studs extending along the length of the framing element 14*a* at spaced intervals. Once that the studs 14*b* have been properly positioned along the length of the element 14*a*, the construction tool 10 is inserted between the walls 18 of the vertical framing element or stud 14*b* as shown in FIGS. 2 and 3. The head portion 11 of the construction tool is placed between the walls 18 so that the longitudinal axis of the body portion 11 is at an angle to the horizontal as shown in dotted lines in FIG. 4. Although the distance between the outer surfaces 24 is approximately equal to the distance between the side walls 18, tilting of the head 11 as shown in FIG. 4 enables the head to be inserted between the walls 18 with plenty of clearance. The head 11 is then lowered to the bottom wall 16 and the tool 10 is twisted to the full line position shown in FIG. 4 so that the bottom surface 26 lies flat against the bottom wall 16 of the construction element 14*a* and the outer surfaces 24 of the flanges 20 abut the side walls 18*a* of the construction element 14*b*. There is sufficient give in the side walls 18 of the construction elements to allow the head portion 11 to be forced into the full line position shown in FIG. 4. Since the head 11 fits snugly between the side walls 18, the tool 10 is used to properly align the upright element 14*b* relative to the bottom element 14*a*. This is accomplished by applying a slight sideways pressure to the hand grip 32. As shown in FIG. 3, the end surfaces 24 at each end of the head portion 11, are spaced sufficiently so that they effectively control the entire width of the adjacent side wall 18. The framing elements 14*a* and 14*b* are then fastened together by screws 35 or other fastening elements while maintaining the elements in proper alignment with the tool 10. The flanges 20 provide firm bracing between the walls 18 for insertion of the screws 35 and the recesses 22 provide space for the screws to extend after they have penetrated the walls 18 of both framing elements 14*a* and 14*b*, as shown in FIG. 3. The firm bracing provided by the head portion 11 enables the screws 35 to be applied more quickly and easily than in the past and prevents any distortion of the side walls 18. In addition, the aligning properties of the construction tool 10 ensure a consistently high quality framing construction. By using the construction tool 10 of the present invention, all of the framing elements in the finished construction will be properly aligned and undamaged. The tool 10 is also used to fasten the upper portions of the upright framing elements 14*b* to a similar horizontally extending framing element, such as 14*a* which is attached to the ceiling of the construction. In addition, the construction tool 12 can be used all along the length of the upright framing elements 14*b* for application of dry wall or paneling to the side walls 18 of the framing elements.

Figure 6:
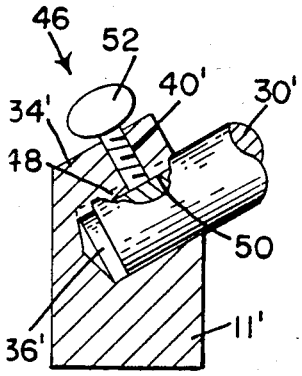
FIG. 6 is a view similar to FIG. 5, showing a modification.

Referring to FIG. 6, there is shown a modified tool generally indicated by the reference numeral 46. The tool 46 is identical to the tool 10 except that the head portion which is indicated by the reference numeral 11' has a smooth bore 36' for receiving the shank portion 30' of the tool. The wall of the bore 36' is provided with a key or spline 48 which is adapted to fit into a slot or keyway 50 in the shank 30' when the shank is inserted into the bore as shown in FIG. 6. This prevents the shank 30' from rotating about its longitudinal axis relative to the main body portion 11'. The main body portion 11' is also provided with a threaded aperture 40' for receiving a thumb screw 52. The aperture 40' extends through the key 48 so that when the screw is fully inserted into the aperture 40' it extends into the keyway 50. The screw can be easily tightened by hand to prevent the shank 30' from moving axially relative to the main body portion 11'. The advantage of the tool 46 is that the handle can be easily and quickly removed from the main body portion for application to a main body portion of a different size. If desired, the handle and main body portion of the construction tool can be formed as one integral piece.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to be secured by Letters Patent is:

1. Construction tool for metal framing elements having a generally U-shaped cross-sectional configuration consisting of a bottom wall and two side walls with the side walls being substantially parallel with each other and the distance between the side walls being defined as the width of the framing element, said tool comprising:

(a) a main body portion comprising:

(1) a bottom surface which is adapted to rest on the bottom wall of the framing element, (2) a top surface which is opposite said bottom surface, and (3) a pair of opposite end surfaces, the distance between said end surfaces being equal to the width of the framing element, each of said end surfaces having a recess which extends from said bottom surface to said top surface, said recess being substantially at a right angle to said bottom surface, and (b) a handle which is attached to the main body portion, said handle having an elongated shank portion having a longitudinal axis which is at an angle to said bottom surface and to each of said recesses.

2. Construction tool as recited in claim 1, wherein each of said recesses is defined by a pair of spaced flanges.

3. Construction tool as recited in claim 2, wherein each of said flanges has a vertical end surface and the end surfaces of each pair of flanges are co-planar.

4. Construction tool as recited in claim 1, wherein said handle includes a hand grip portion attached to the outer end of said shank portion.

5. Construction tool as recited in claim 4, wherein said hand grip portion is a rod having an axis which is transverse to the central longitudinal axis of said shank portion.

6. Construction tool as recited in claim 1, wherein the handle is removably attached to the main body portion.

7. Construction tool as recited in claim 6, wherein one end of the handle is threaded and said body portion has a threaded bore for receiving said threaded end.

8. Construction tool as recited in claim 7, wherein said body is provided with a threaded aperture which intersects said bore and a set screw is threaded into said aperture for locking the threaded end of the handle when said threaded end is inserted into said bore.

9. Construction tool as recited in claim 6, wherein said body portion has a bore which is provided with a longitudinal spline and one end of the handle is provided with a longitudinal slot for receiving said spline, said body portion being provided with a threaded aperture which intersects said bore for receiving a locking screw.

* * * * *